US007182647B2

(12) United States Patent
Muench et al.

(10) Patent No.: US 7,182,647 B2
(45) Date of Patent: Feb. 27, 2007

(54) VISIBLE BREAK ASSEMBLY INCLUDING A WINDOW TO VIEW A POWER CONNECTION

(75) Inventors: Frank John Muench, Waukesha, WI (US); Brian Todd Steinbrecher, Brookfield, WI (US); Edine Mary Heinig, Pewaukee, WI (US); David Charles Hughes, Sussex, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/996,179

(22) Filed: Nov. 24, 2004

(65) Prior Publication Data

US 2006/0110983 A1 May 25, 2006

(51) Int. Cl.
*H01R 24/00* (2006.01)
*H01R 33/00* (2006.01)
*H01R 3/00* (2006.01)

(52) U.S. Cl. ..... 439/660; 439/488; 439/18

(58) Field of Classification Search ..... 439/660, 439/488, 18, 20, 21, 23
See application file for complete search history.

(56) References Cited

U.S. PATENT DOCUMENTS

| | | | |
|---|---|---|---|
| 1,783,062 | A | 11/1930 | Trencham |
| 1,997,081 | A | 4/1935 | Reynolds |
| 2,605,389 | A | 7/1952 | Kimball |
| 2,667,532 | A | 1/1954 | Ewer |
| 2,892,991 | A | 6/1959 | Beebee et al. |
| 3,392,363 | A | 7/1968 | Geis, Jr., et al. |
| 3,474,386 | A | 10/1969 | Link |
| 3,509,518 | A | 4/1970 | Phillips |
| 3,513,425 | A | 5/1970 | Arndt |
| 3,652,975 | A | 3/1972 | Keto |
| 3,663,928 | A | 5/1972 | Keto |
| 3,670,287 | A | 6/1972 | Keto |
| 3,678,432 | A | 7/1972 | Boliver |

(Continued)

FOREIGN PATENT DOCUMENTS

| | | |
|---|---|---|
| GB | 2254493 | 10/1992 |

(Continued)

OTHER PUBLICATIONS

Cooper Power Systems, *Loadbreak Apparatus Connectors,* "200 A kV and 28 kV Class—Expanded Range Loadbreak Elbow Connector-Canadian Standards Edition", Electrical Apparatus 500-28C, pp. 1-6, Feb. 2002.

(Continued)

*Primary Examiner*—Chandrika Prasad
(74) *Attorney, Agent, or Firm*—Fish & Richardson P.C.

(57) ABSTRACT

A device includes a first conductive member configured to be electrically coupled to a first component and a second conductive member configured to be electrically coupled to a second component. The second conductive member is separated from the first conductive member by a gap. A conductive connecting member is moveable to make an electrical connection between the first and second conductive members across the gap. A housing receives the first conductive member, the second conductive member, and the connecting member. The housing includes an insulating layer and a conductive layer. The movement of the connecting member to make the electrical connection is visible through at least a portion of the insulating layer and the conductive layer.

52 Claims, 15 Drawing Sheets

U.S. PATENT DOCUMENTS 3,720,904 A 3/1973 De Sio
3,740,503 A * 6/1973 Tomohiro et al. ..... 200/61.47
3,826,860 A 7/1974 De Sio et al.
3,835,439 A 9/1974 Yonkers
3,860,322 A 1/1975 Sankey et al.
3,915,534 A 10/1975 Yonkers
3,953,099 A 4/1976 Wilson
3,955,874 A 5/1976 Boliver
3,957,332 A 5/1976 Lambert, III
3,960,433 A 6/1976 Boliver
4,040,696 A * 8/1977 Wada et al. ..... 439/23
4,067,636 A 1/1978 Boliver et al.
4,113,339 A 9/1978 Eley
4,123,131 A 10/1978 Pearce, Jr. et al.
4,203,017 A * 5/1980 Lee ..... 200/437
4,210,381 A 7/1980 Borgstrom
4,223,179 A 9/1980 Lusk et al.
4,260,214 A 4/1981 Dorn
4,722,694 A 2/1988 Makal et al.
4,793,637 A 12/1988 Laipply et al.
4,822,291 A 4/1989 Cunningham
4,863,392 A 9/1989 Borgstrom et al.
4,867,687 A 9/1989 Williams et al.
4,911,655 A 3/1990 Pinyan et al.
4,972,049 A 11/1990 Muench
5,045,656 A * 9/1991 Kojima ..... 200/314
5,114,357 A 5/1992 Luzzi
5,130,495 A 7/1992 Thompson
5,213,517 A 5/1993 Kerek et al.
5,221,220 A 6/1993 Roscizewski
5,230,640 A 7/1993 Tardif
5,248,263 A 9/1993 Sakurai et al.
5,266,041 A 11/1993 De Luca
5,356,304 A 10/1994 Colleran
5,358,420 A 10/1994 Cairns et al.
5,359,163 A * 10/1994 Woodard ..... 200/249
5,393,240 A 2/1995 Makal et al.
5,429,519 A * 7/1995 Murakami et al. ..... 439/310
5,433,622 A 7/1995 Galambos
5,435,747 A * 7/1995 Franckx et al. ..... 439/409
5,492,487 A 2/1996 Cairns et al.
5,589,671 A * 12/1996 Hackbarth et al. ..... 200/6 R
5,619,021 A * 4/1997 Yamamoto et al. ..... 200/6 A
5,641,310 A 6/1997 Tiberio, Jr.
5,795,180 A 8/1998 Siebens
5,816,835 A 10/1998 Meszaros
5,857,862 A 1/1999 Muench et al.
5,957,712 A 9/1999 Stepniak
6,168,447 B1 1/2001 Stepniak et al.
6,213,799 B1 4/2001 Jazowski et al.
6,250,950 B1 * 6/2001 Pallai ..... 439/441
6,504,103 B1 1/2003 Meyer et al.
6,538,312 B1 * 3/2003 Peterson et al. ..... 257/680
6,542,056 B2 * 4/2003 Nerstrom et al. ..... 335/17
6,566,996 B1 * 5/2003 Douglass et al. ..... 337/243
6,585,531 B1 7/2003 Stepniak et al.
6,674,159 B1 * 1/2004 Peterson et al. ..... 257/680
6,705,898 B2 * 3/2004 Pechstein et al. ..... 439/660
6,709,294 B1 * 3/2004 Cohen et al. ..... 439/608
6,809,413 B1 * 10/2004 Peterson et al. ..... 257/680
6,984,791 B1 1/2006 Meyer et al.
2001/0008810 A1 * 7/2001 George et al. ..... 439/13

FOREIGN PATENT DOCUMENTS

JP 62-198677 12/1987
JP 63-93081 6/1988
JP 1-175181 7/1989
JP 3-88279 9/1991
JP 4-54164 5/1992

OTHER PUBLICATIONS

Cooper Power Systems, *Deadbreak Apparatus Connectors,* "600 A 15/25 kV Class Bol-T™ Deadbreak Connector", Electrical Apparatus 600-30, pp. 1-6, Feb. 2003.
Cooper Power Systems, *Deadbreak Apparatus Connectors,* "600 A 15/25 kV Class PUSH-OP® Deadbreak Connector", Electrical Apparatus 600-33, pp. 1-4, Nov. 2004.
Cooper Power Systems, *Molded Rubber Products,* "600 A 15/25 kV Class T-OP™ II Deadbreak Connector", Electrical Apparatus 600-32, pp. 1-4, Jul. 2005.
Cooper Power Systems, *OEM Equipment,* "Four-Position Sectionalizing Loadbreak Switches", Electrical Apparatus 800-64, pp.1-8, Dec. 2003.
PCT International Search Report (PCT/US05/42361) dated Jun. 28, 2006 (3 pages).
PCT Written Opinion of the International Searching Authority (PCT/US05/42361) dated Jun. 28, 2006 (5 pages).

* cited by examiner

VISIBLE BREAK ASSEMBLY INCLUDING A WINDOW TO VIEW A POWER CONNECTION

TECHNICAL FIELD

This document relates to power connectors.

BACKGROUND

Electrical power is transmitted from substations through cables connected to electrical equipment or other cables which, in turn, connect to other pieces of electrical apparatus. The cables can be terminated on bushings which may pass through walls of metal-encased equipment such as capacitors, transformers or switchgear. The bushings also can connect two cables together.

The bushings typically are made from insulating materials such as epoxy, other plastics and various types of rubber. The construction of the bushing uses multiple layers. There is typically a conductor made from a metal, such as copper or aluminum, that efficiently conducts electrical current. A voltage shield, made of a conductive material, covers an interior of the bushing and surrounds the conductor. The voltage shield causes air within the bushing or around the conductor to be at the same electrical potential as the conductor so as to inhibit discharges that could damage the bushing. An insulating layer is molded over the voltage shield to insulate the bushing from the outside environment. An external ground shield, made of a conductive material, is molded around the outside of the insulating layer to maintain the exterior of the bushing at ground potential. This allows any capacitive charge that develops from the electric field and voltage drop across the insulation to be drained away, which increases safety by preventing capacitive accumulation of charge on the outer diameter of the bushing.

When installing or repairing power cables, it is desirable to create a break in the circuit that can be seen by the operator. One way that this is done is by removing a cable from the bushing and grounding the cable at its connection point. This requires unbolting and removing a connector from the bushing with remote operating tools that keep the operator several feet away from the bushing and may be difficult to operate. Another way this is done is to place a switch in the circuit that has contacts that open to provide a gap and provisions to allow the line operator to see the gap, before applying ground to the end of the cable. Such switching devices often use transparent liquids, such as oils, or transparent gases, such as air or SF6. A third system provides the ability to ground the circuit, but without a visible disconnection.

SUMMARY

In one aspect, a device includes a first conductive member configured to be electrically coupled to a first component and a second conductive member configured to be electrically coupled to a second component. The second conductive member is separated from the first conductive member by a gap. A conductive connecting member is moveable to make an electrical connection between the first and second conductive members across the gap. A housing receives the first conductive member, the second conductive member, and the connecting member. The housing includes an insulating layer and a conductive layer. The movement of the connecting member to make the electrical connection is visible through at least a portion of the insulating layer and the conductive layer.

Implementations of this aspect can include one or more of the following features.

The conductive layer may include a transparent or translucent conductive material, such as a metallic mesh screen or a metallic spray-on coating. The conductive layer may be formed from a flexible transparent circuit board with metallic portions etched onto the circuit board. The conductive material may be tinted. The insulating layer may include a transparent or translucent insulating material, such as acrylic, epoxy, or urethane. The insulating material may be tinted.

The conductive layer may include an external ground shield layer. The housing may further include an internal voltage shield layer having at least a portion through which the movement of the connecting member to make the electrical connection is visible. The insulating layer may be sandwiched between the ground shield layer and the voltage shield layer. The conductive layer and/or the insulating layer may include an opaque portion through which the movement of the connecting member to make the electrical connection is not visible.

The conductive connecting member may include a rotatable contact coupled to the first conductive member. The second conductive member may include a stationary contact. The housing may include a base member that receives the second conductive member. The portion through which movement is visible may include a window that projects from the base member and/or that is shaped like the frustrum of a cone. The housing may include a tip member that projects from the portion though which movement is visible and that is coupled to the first conductive member. The tip member may be configured to rotate the rotatable contact.

The conductive connecting member may include a conductive shaft that is rotatable between an open position in which the conductive shaft is not in contact with at least one of the first and second conductive members, and a closed position in which the conductive shaft is in contact with both the first and second conductive members. The housing may include a wall and a cover that define an interior, open space that contains the conductive shaft. The cover may include the portion through which movement is visible. The wall may include an opaque layer through which movement of the conductive connecting member is not visible. The wall may include a first bushing for receiving the first conductive member and/or a second bushing for receiving the second conductive member. A non-conductive shaft may be coupled to the conductive shaft. The non-conductive shaft may be rotatable about an axis to rotate the conductive shaft between the open position and the closed position. The cover may include a bearing and the non-conductive shaft may extend through the bearing and outside of the housing.

The conductive connecting member may include a conductive rod that defines a longitudinal axis, such that the rod is moveable along the axis. The housing may include a bushing that defines a bore for receiving the rod. The bushing may include the portion through which movement is visible. The housing may include a T-shaped casing coupled to the bushing for electrically coupling the second conductive connecting member to the second component. The casing may include a stem portion that defines a bore for receiving the second component. The casing also may include a cross portion that defines a bore for receiving the bushing and the conductive rod.

The conductive rod may include an arc follower and the bushing may include an arc snuffing assembly that inhibit the formation of an arc between first conductive connecting member and the conductive rod. The conductive rod may include a conductive portion and an insulating portion coupled to the conductive portion. The insulating portion may include a tooth and the housing includes a groove, e.g., a Z-shaped groove, for interlocking with the tooth. The conductive rod and the bushing may include a locking mechanism, such as a protrusion and an annular groove on the rod for locking with the finger contacts. The device may also include a grounding rod configured to ground the housing when the conducting rod has been removed from the housing.

The housing may include a 600A rubber T-connector for receiving the conductive rod. The T-connector may include a stem portion that defines a longitudinal bore for receiving the conductive rod. The T-connector may include a connector plug received in the longitudinal bore for forming an electrical connection with the conductive rod.

In another aspect, a method includes: moving a conductive connecting member to form and to break an electrical connection between a first conductive member that is electrically coupled to a first component and a second conductive member that is electrically coupled to a second component, the second conductive member being separated from the first conductive member by a gap; and viewing the movement of the conductive connecting member through a portion of a housing that receives the first conductive member, the second conductive member, and the connecting member, in which the portion includes an insulating layer and a conductive layer that electrically shields the housing.

In another aspect, a method of manufacturing a visible break device is disclosed. The visible break device includes a housing that receives first conductive member configured to be electrically coupled to a first component, a second conductive member configured to be electrically coupled to a second component, and a conductive connecting member that is moveable across a gap to form and to break an electrical connection between the first and second conductive members. The housing includes a transparent or translucent portion that includes a transparent or translucent insulating layer and a transparent or translucent conductive layer. The method of manufacturing includes filling a mold with a transparent or translucent insulating material to form the insulating layer. One implementation of this aspect includes placing the first conductive member and the second conductive member into the mold.

The details of one or more implementations are set forth in the accompanying drawings and the description below. Other features and advantages will be apparent from the description and drawings, and from the claims.

DETAILED DESCRIPTION

Figure 1:
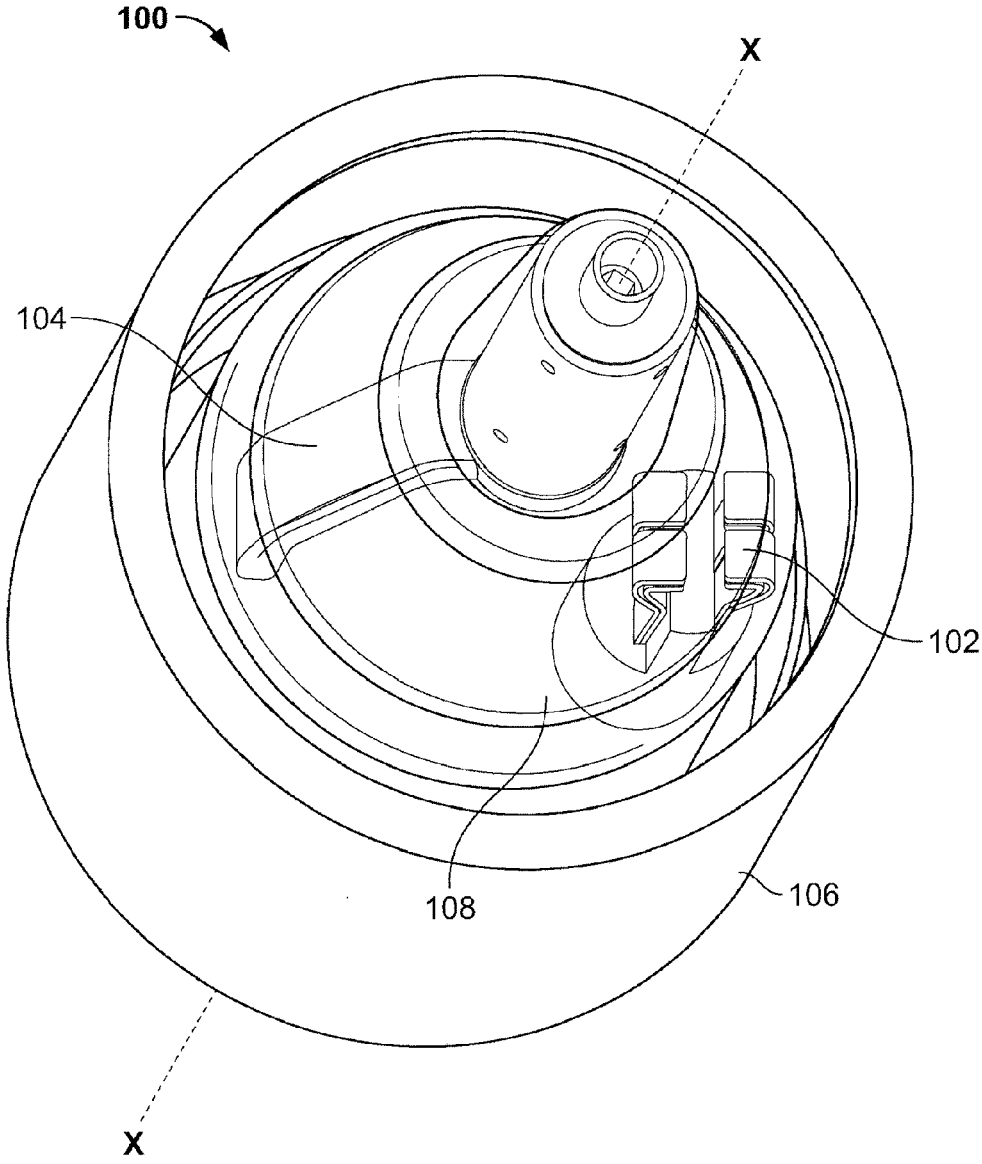
FIG. 1 is a perspective view of a visible break assembly in an open position.
Figure 2:
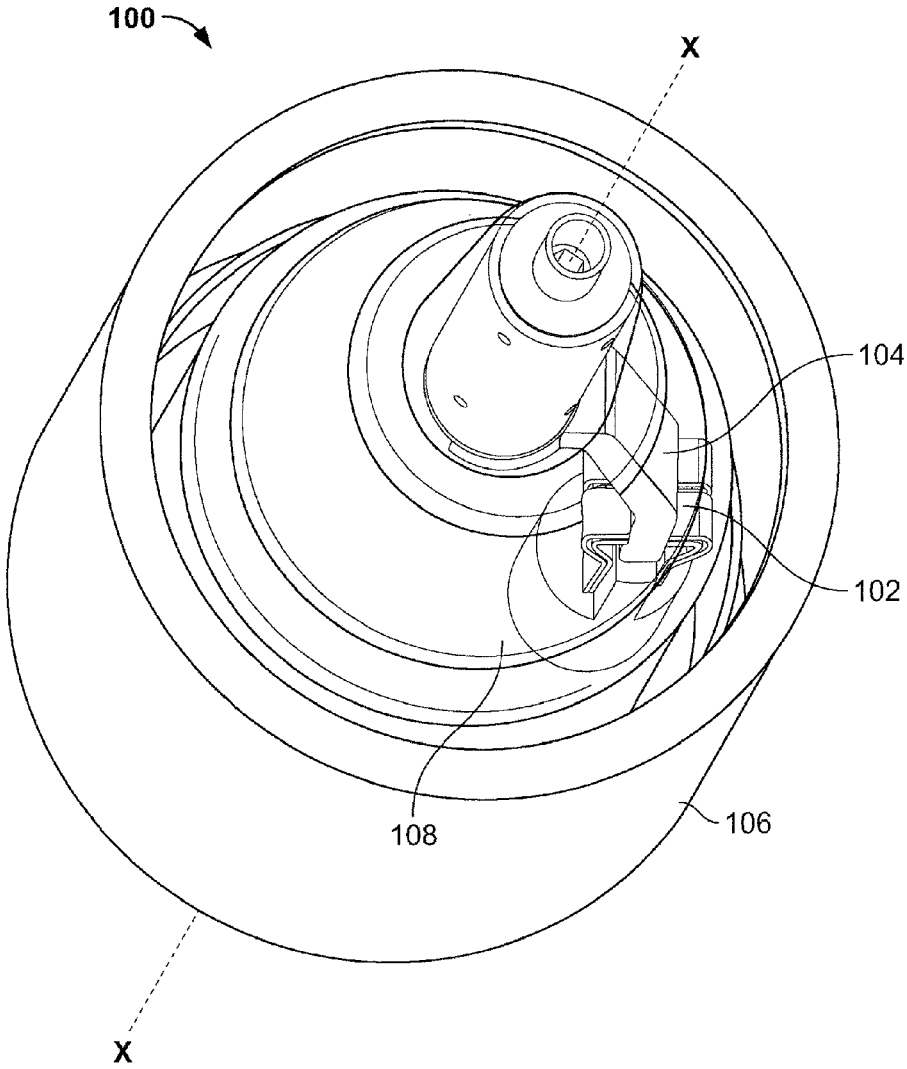
FIG. 2 is a perspective view of the visible break assembly of FIG. 1 in a closed position.

Referring to FIGS. 1 and 2, in one implementation, a visible break assembly 100 includes a first electrically conductive member in the form of a stationary contact 102 and a second electrically conductive member in the form of a rotatable contact 104. The contacts 102 and 104 can be electrically connected between first and second pieces of electrical equipment, such as high voltage power cables (not shown). Rotatable contact 104 is rotatable about an axis X—X between an open position, in which there is an electrical gap between rotatable contact 104 and stationary contact 102 (FIG. 1), and a closed position, in which rotatable contact 104 is electrically connected to stationary contact 102 (FIG. 2). Contacts 102 and 104 are housed in a housing 106 with a transparent or translucent window 108 through which the connection status of contacts 102 and 104 is visible from outside of housing 106.

Figure 3:
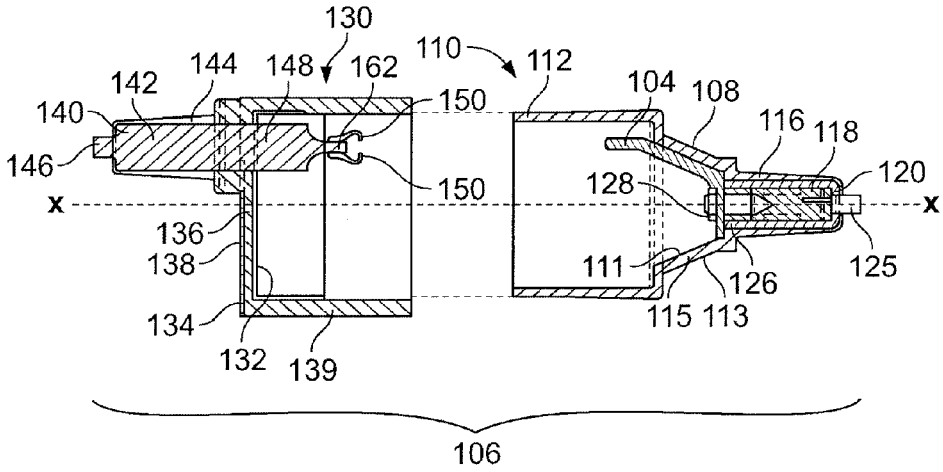
FIG. 3 is an exploded cross-sectional view of the visible break assembly of FIG. 1.

Referring also to FIG. 3, housing 106 includes an inner half 110 and an outer half 130. Inner half 110 includes a substantially cylindrical base member 112 configured to be received within outer half 130; the window 108, which is shaped like the frustrum of a cone that projects from base member 112; and a substantially cylindrical tip member 116 that projects from window 108. The position of rotatable contact 104 is visible through window 108. Window 108 includes an inner conductive voltage shield layer 111, an outer conductive ground shield layer 113, and an insulating layer 115 sandwiched between voltage shield layer 111 and ground shield layer 113. Voltage shield layer 111 and ground shield layer 113 each are composed of conductive material that is either transparent or translucent, or includes an opening through which light may be transmitted (throughout this description, such materials are referred to as being light-passing materials). For example, voltage shield layer 111 and/or ground shield layer 113 may include a metallic mesh screen or a translucent metallic spray-on coating, such as those used for static shields on plastic bags used to ship circuit boards. In another implementation, voltage shield layer 111 and/or ground shield layer 113 can be formed from a flexible transparent circuit board with metallic portions etched onto the circuit board. Insulating layer 115 may be composed of a transparent or translucent insulating material, such as acrylic, epoxy, urethane, or other polymeric materials. Voltage shield layer 111, ground shield layer 113, and/or insulating layer 115 may be tinted, such as with dye or pigment, as long as the position of rotatable contact 104 is visible through window 108. Base member 112 and tip member 116 each include a voltage shield layer, a ground shield layer, and an insulation layer. While these layers are opaque in the illustrated implementation, they may not be opaque in other implementations.

A rotatable rod 120 mounted for rotation relative to housing 106 is affixed to rotatable contact 104 by a bolt 128. Rotatable rod 120 is received in a conductive sleeve 118 that is held stationary within tip member 116. Conductive sleeve 118 is configured to be electrically connected to the second piece of electrical equipment (not shown). Rotatable rod 120 includes a conductive portion 126 that is electrically connected to conductive sleeve 118 by a known current interchange mechanism for a high voltage connection, such as a current interchange spring 122 and drive pins 124. Rotatable rod 120 also has an end portion 125 that extends outside of tip member 116. End portion 125 is hex-shaped so that it can be rotated by a tool having a corresponding hex-shaped head. When end portion 125 is rotated, conductive rod 120 rotates contact 104 about axis X—X to make or break the connection between rotatable contact 104 and fixed contact 102.

Outer half 130 is cup shaped with a back wall 138 and a substantially cylindrical side wall 139 to receive cylindrical base member 112 of inner member 110. Walls 138 and 139 each include an internal voltage shield layer 132, an external ground shield layer 134, and an insulating layer 136 sandwiched between voltage shield layer 132 and ground shield layer 134. Voltage shield layer 132, ground shield layer 134, and insulating layer 136 can be composed of light-passing materials, as described above, or can be composed of known opaque materials. Extending through back wall 138 and offset from axis X—X is a conductive stud 140. Stud 140 includes an exterior portion 142 that is covered by insulation 144 except for an end projection 146 that extends outside of back wall 139 to be attached to the first piece of electrical equipment (not shown). Stud 140 also has an interior portion 148 extending inside outer half 130, which is connected to stationary contact 102, such as by welding or brazing. Contact 102 includes two or more finger-like projections 150 that are configured to mate with rotatable contact 104.

Visible break assembly 100 is assembled and used as follows. First, to assemble inner half 110, shields 111 and 113 and conductive sleeve 118 are placed into a mold. Insulation material is injected or poured into the mold in liquid form and allowed to solidify to form insulation portion 116. Rotatable rod 120 is mounted within conductive sleeve 118 using current interchange spring 122 and pins 124, and rotatable contact 104 is attached to interior end 126 of conductive rod 120. To assemble outer half 130, voltage shield layer 132, ground shield layer 134, and stud 140 are placed into a mold and liquid insulation material is poured into the mold to form insulation layer 136 and insulation 144. Stationary contact 102 is attached to stud 140 by welding, brazing, or through the use of fasteners. Inner half 110 is received within outer half 130 and attached, using, for example, an adhesive, an external clamp, or mating threads on inner half 110 and outer half 130.

The above discussion assumes that the voltage and ground shield layers 111, 113, 132, and 134 are made from pre-existing structures such that they may be inserted into a mold. When the voltage and ground shield layers are in the form of coatings, they may be applied after the insulation portion 116 or the insulation layer 136 is formed.

An operator inserts an electrical cable into an electrical connector (not shown), such as a 600A rubber T-connector, manufactured by Cooper Industries, Inc. Conductive sleeve 118 of inner half 110 is received in the T-connector to form an electrical connection with the electrical cable. Similarly, conductive stud 140 of outer half 130 can be received within another electrical connector, such as another T-connector, to connect to another electrical cable. The operator can use a tool, such as a tool with a hex head, to turn exterior end 125 and rotate contact 104 about axis X—X to make or break an electrical connection between rotatable contact 104 and fixed contact 102. Through window 108, the operator can see when the connection between contacts 102 and 104 is closed or open.

Other implementations of assembly 100 can include one or more of the following features. For example, the outer half can include another stationary contact that has a direct connection to ground rather than to a piece of electrical equipment. In this implementation, the three contacts can be spaced, e.g., at 120° intervals, to allow adequate dielectric withstand. This would allow the assembly to be used as an open, closed, and grounded device. The stationary contact also can be designed to rotate, so that either side can be actuated to open and close the connection between the contacts. A spring mechanism can be added to the rotating contact to cause the rotating contact to rotate only after it has been wound by turning the exterior end by a predetermined amount. This spring loaded turning causes the rotating contact to rotate at a higher speed, which helps to interrupt an arc that could form between the rotating contact and the fixed contact when the connection between them is broken while the circuit is energized and carrying load current. Similarly, the exterior end could be turned by a tool that has a similar spring loaded actuation mechanism built into the tool. In addition, arc-ablative materials could be used inside the housing to inhibit arc formation between the contacts.

Stops could be added to the housing, such as by molding stops into the insulating portions or by attaching pivots or catches, to provide an operator with tactile feedback for when the rotatable contact is closed or open. Similarly, stops can provide tactile feedback for when the rotatable contact has engaged a ground contact, if a ground contact is used. The conductive parts or contacts can be coated with color or reflective material to enhance their visibility. The window may include only a portion or section that is transparent or translucent. Similarly, other portions of the housing can be transparent, translucent, or opaque, in whole or in part. The hollow space within the assembly can be filled with air, insulating fluids, such as sulfur hexaflouride gas, or non-flammable insulating oils.

Referring to FIGS. 4A–6B, in another implementation, a visible break assembly 200 includes a pair of stationary conductors 201 and 202 that each can be electrically connected to a piece of electrical equipment, such as a high voltage power cable (not shown). A rotatable conductor 204 is rotatable about an axis Y—Y between an open position (FIGS. 4A, 5A, and 6A) in which there is an electrical gap between stationary conductors 201 and 202, and a closed position (FIGS. 4B, 5B, and 6B) in which rotatable conductor 204 completes an electrical connection between stationary conductors 201 and 202. Conductors 201 and 202, and 204 are received in a housing 206 that has a transparent or translucent window 208 to allow the position of rotatable conductor 204 relative to stationary conductors 201 and 202 to be visible from outside of housing 206.

Figure 4A:
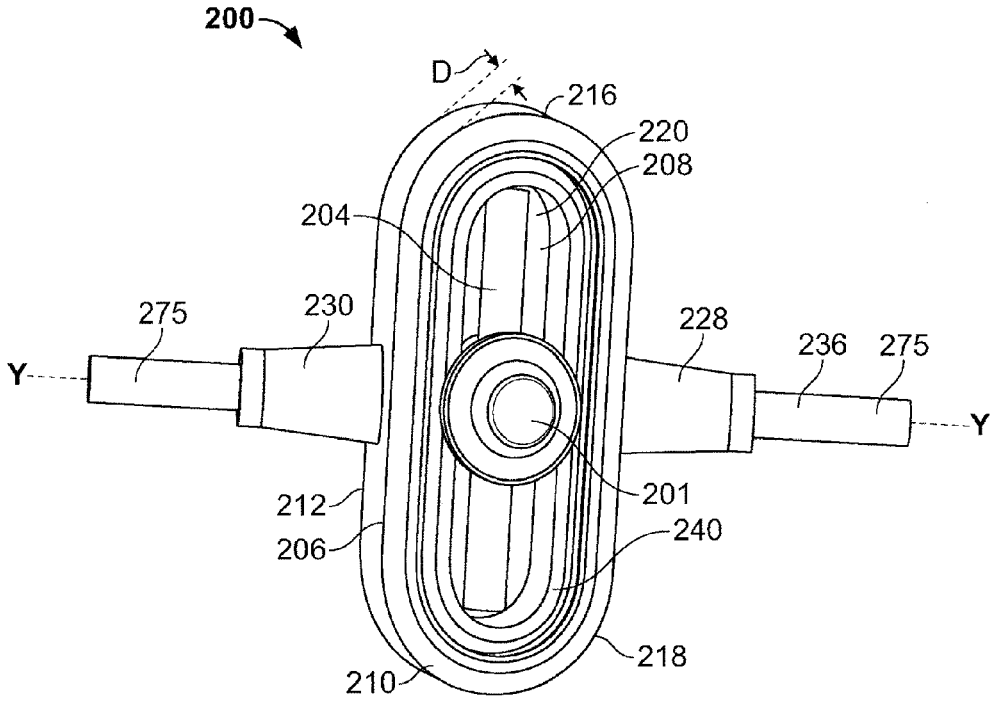
FIG. 4A is a perspective view of another implementation of a visible break assembly in an open position.
Figure 4B:
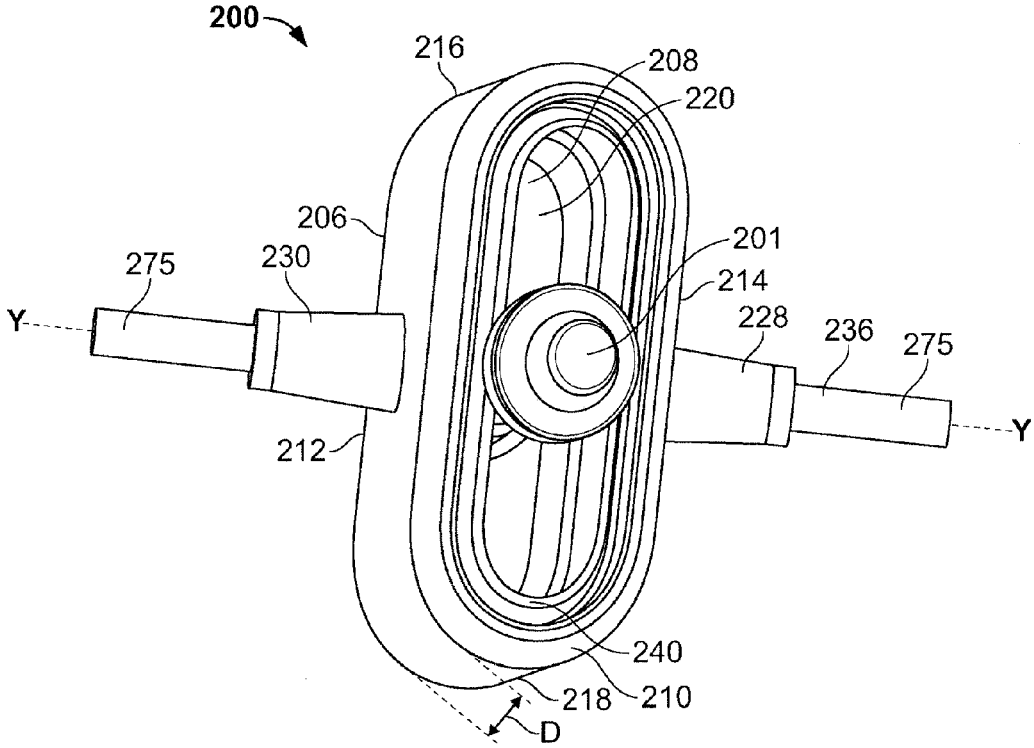
FIG. 4B is a perspective view of the visible break assembly of FIG. 4A in a closed position.
Figure 5A:
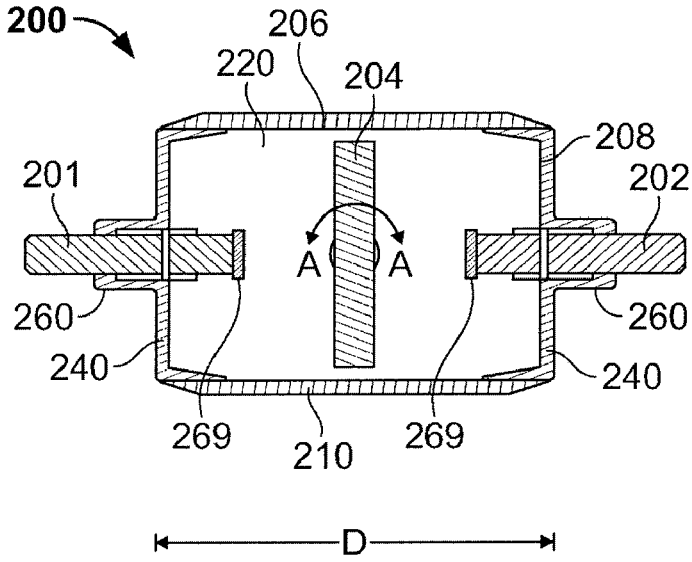
FIGS. 5A and 5B are side cross-sectional views of the visible break assembly of FIGS. 4A and 4B, respectively.
Figure 5B:
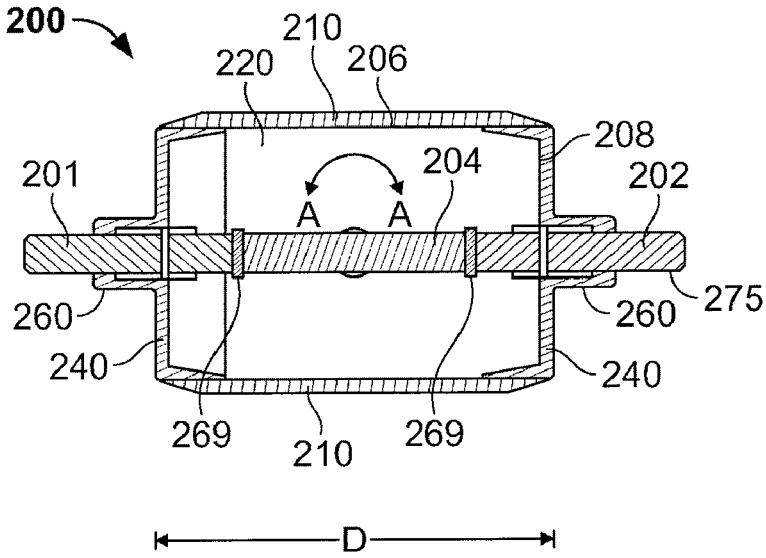
Figure 6A:
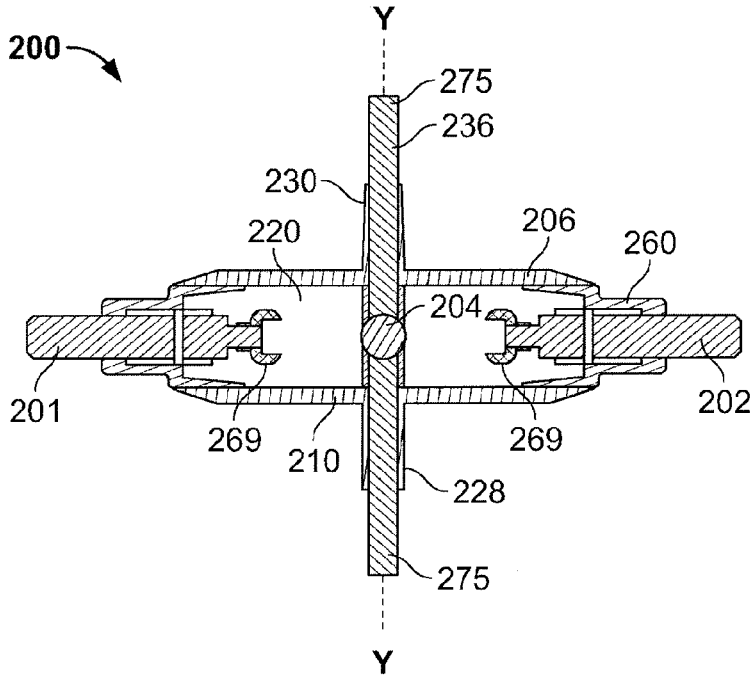
FIGS. 6A and 6B are top cross-sectional views of the visible break assembly of FIGS. 4A and 4B, respectively.
Figure 6B:
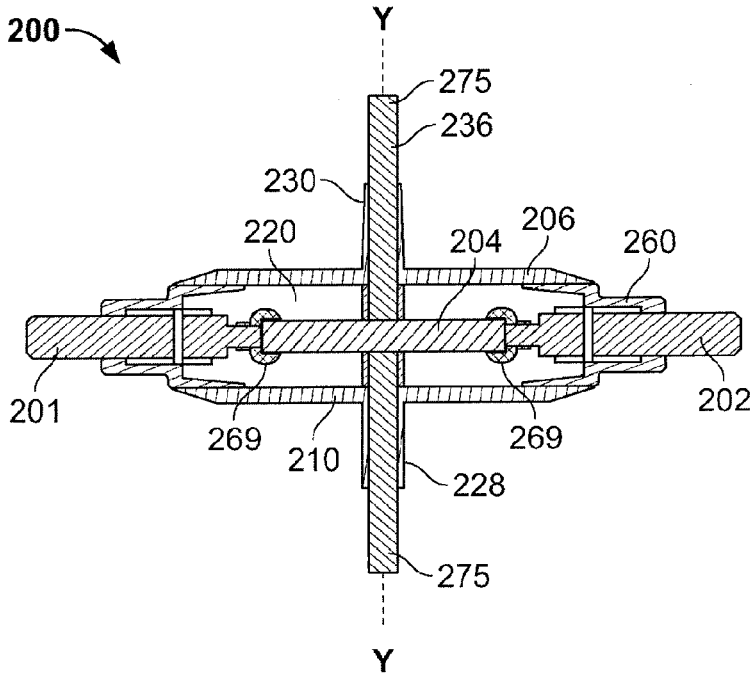

FIGS. 4A and 4B respectively illustrate perspective views of assembly 200 with a gap between rotatable conductor 204 and stationary conductors 201 and 202 and with rotatable conductor 204 in contact with stationary conductors 201 and 202. For ease of showing the positioning of rotatable conductor 204, the depth D of housing 206 is exaggerated as being smaller than the actual depth as compared to the other dimensions of housing 204. FIGS. 5A and 5B, while also not to scale, more accurately depict the depth D relative to the other dimensions of housing 206.

Figure 7:
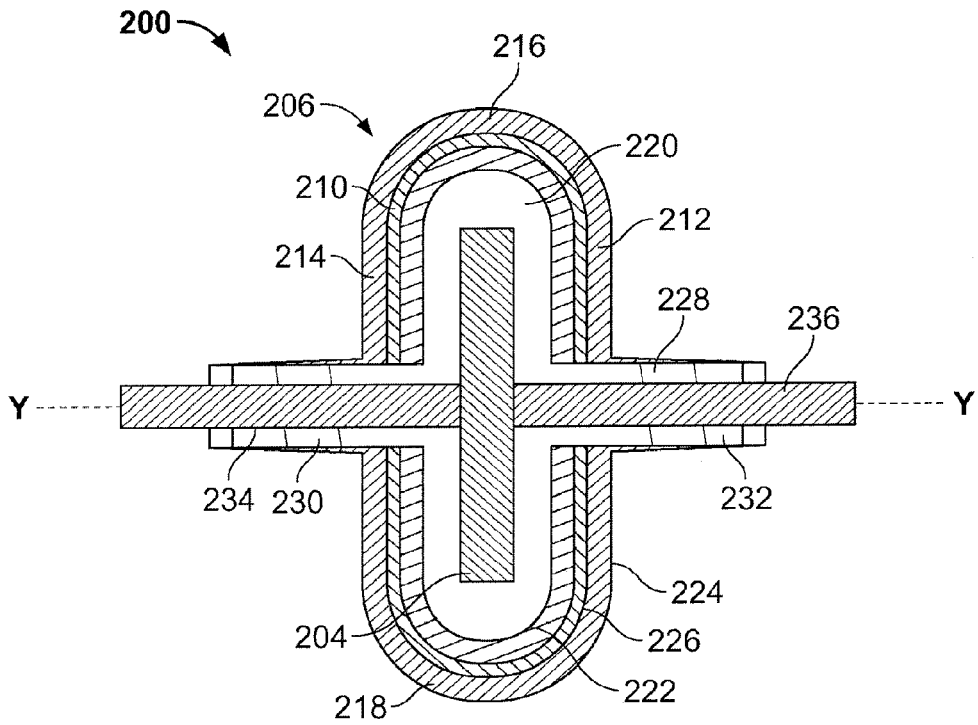
FIG. 7 is a front view of a wall and shaft of the visible break assembly of FIG. 4A.

Referring also to FIG. 7, housing 206 includes a generally oval wall 210 having parallel side wall portions 212 and 214 that are connected to semi-circular end-wall portions 216 and 218, to define an interior, open space 220. Each portion of wall 210 includes an opaque, internal voltage shield layer 222, an opaque, external ground shield layer 224, and an opaque insulating layer 226 sandwiched between the voltage shield layer 222 and the ground shield layer 224. In other implementations, layers 222, 224, and 226 can be transparent or translucent, as described above. Side wall portions 212 and 214 each include bearings 228 and 230 that define apertures 232 and 234 that are in communication with open space 220. Bearings 228 and 230 are configured to receive a non-conductive rotating shaft 236 so that shaft 236 passes through open space 220. Shaft 236 is coupled perpendicularly to rotatable conductor 204 such that turning shaft 236 about axis Y—Y rotates conductor 204 in the direction of arrow A to make and break connections with conductors 201 and 202. Shaft 236 includes end portions 275 that extend out of bearings 228 and 230. To assist in turning shaft 236 with a hex-shaped tool, end portions 275 have corresponding hex shapes.

Figure 8:
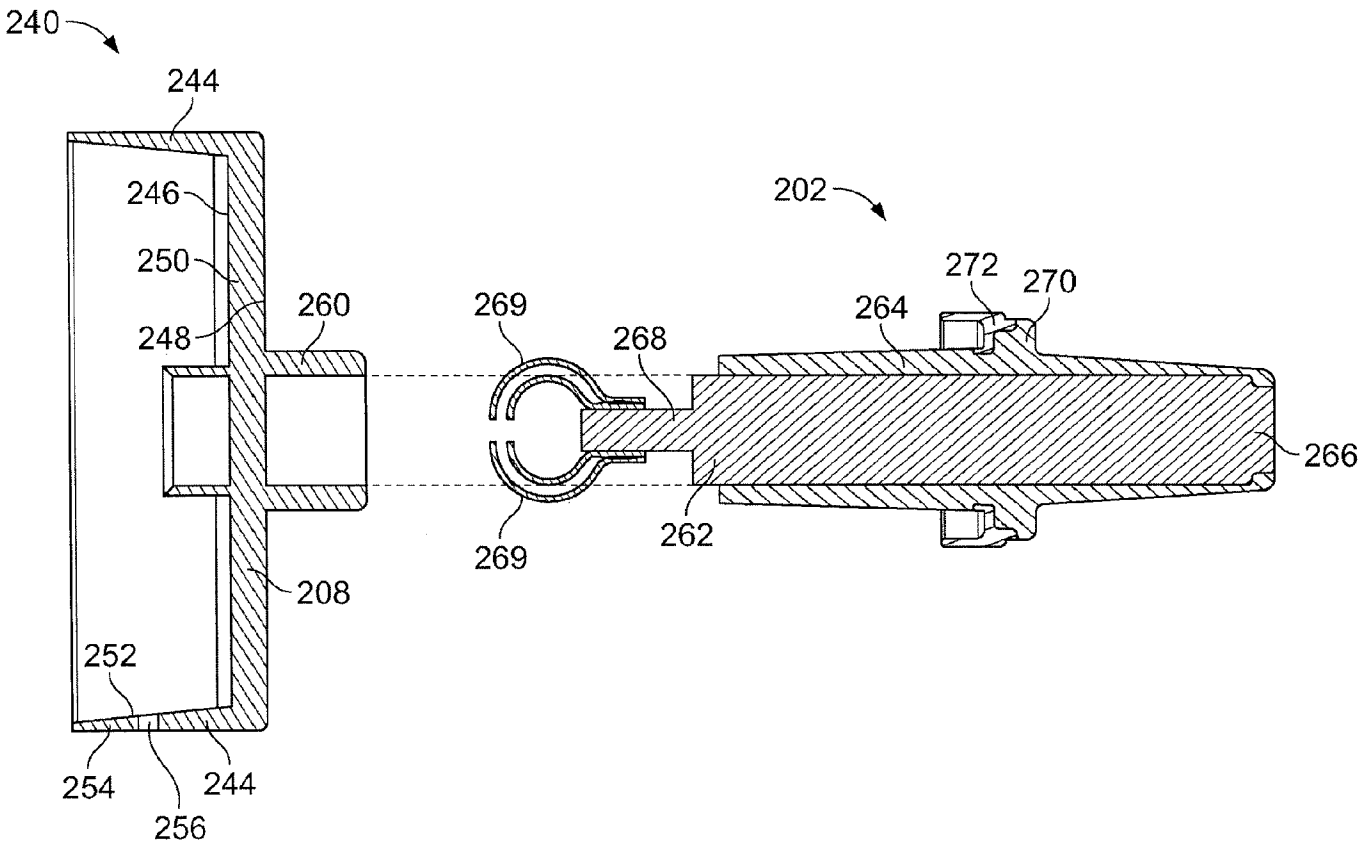
FIG. 8 is an exploded cross-sectional view of a cover and fixed conductor of the visible break assembly of FIG. 4A.
Figure 9:
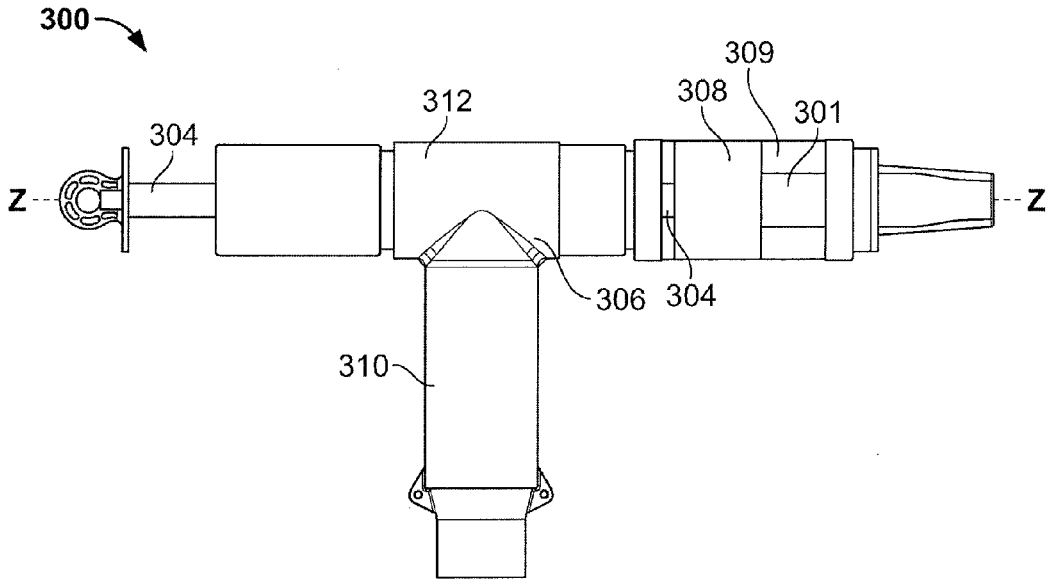
FIG. 9 is a side view of another implementation of a visible break assembly in an open position.

Referring also to FIG. 8, housing 206 includes a pair of covers 240 received in wall 210 to enclose open space 220 (only front cover 240 is shown in FIG. 8). Cover 240 includes the window 208 and a side wall 244 depending from window 208. Window 208 includes an internal, conductive voltage shield layer 246, an external, conductive ground shield layer 248, and an insulating layer 250 sandwiched between the voltage shield layer 246 and the ground shield layer 248. Ground shield layer 248 and voltage shield layer 246 are composed of light-passing materials to allow the positioning of rotatable conductor 204 to be visible from outside of housing 206, as described above with respect to voltage shield layer 111 and ground shield layer 113. Insulating layer 250 is composed, for example, of a non-conductive transparent or translucent material, as described above with respect to insulating layer 115. Side wall 244 also is composed of an internal voltage shield layer 252, an external ground shield layer 254 and an insulating layer 256 sandwiched therebetween. Layers 252 and 254 can be composed of light-passing materials, and layers 256 can be composed of transparent or translucent materials, as described above, or the layers 252, 254, and 256 can be composed of known opaque materials.

Extending from window 208 is a bushing 260 for receiving the stationary conductor 202. Stationary conductor 202 includes a generally cylindrical conductive rod 262 composed of an electrically conductive material such as copper or aluminum, which is encased in a generally cylindrical insulating sleeve 264, composed of a transparent, translucent, or opaque insulating material, such as rubber or plastic. Rod 262 includes an external end portion 266 that is exposed for electrically connecting rod 262 to a power cable (not shown) and an internal end 268 that is coupled to a plurality of finger contacts 269 that are configured to mate with rotatable conductor 204. Stationary conductor 202 also includes an annular flange 270 that includes a conductive grounding layer 272. When stationary conductor is received in bushing 260, grounding layer 272 abuts against ground shield layer 248 to assist in grounding the device.

Visible break assembly 200 is assembled and used as follows. Shaft 236 is coupled to rotatable conductor 204 and shaft 236 is received for rotation in bearings 228, 230. Each of stationary contacts 201 and 202 is inserted into a bushing 260 in cover plate 240. Cover plates 240 are then secured to the front and back of wall 210 to enclose open space 220. An operator inserts an electrical cable into an electrical connector (not shown), such as a 600A rubber T-connector, described above. Conductive end portion 266 of stationary conductor 202 is received in the T-connector to form an electrical connection with the electrical cable. Similarly, conductive end portion 266 of stationary conductor 201 can be received within another electrical connector, such as another T connector. The operator uses a tool with a hex-shaped head to turn one of exterior ends 275 of shaft 236 and rotate shaft 236 about axis Y—Y. The rotation of shaft 236 causes rotatable conductor 204 to turn and to make or break an electrical connection with finger contacts 269 of stationary conductors 201 and 202. The position of rotatable conductor relative to stationary conductors 201 and 202 is visible through window 208.

Other implementations of assembly 200 can include one or more of the following features. Additional rubber can be added to portions of the assembly, such as the bearings for the rotating shaft, to increase the dielectric withstand of the assembly. A spring mechanism can be added to the shaft to cause the rotatable conductor to rotate only after the shaft has been wound. This spring loaded turning causes the rotating conductor to rotate at a higher speed, which helps to aid in the interruption of an arc that may form between the rotating and the fixed conductors when the connection between them is broken. Alternatively, the shaft could be turned by a tool that has a similar spring loaded actuation mechanism built into the tool. In addition, arc-ablative materials could be used inside the housing to help inhibit arc formation between the conductors.

Figure 10:
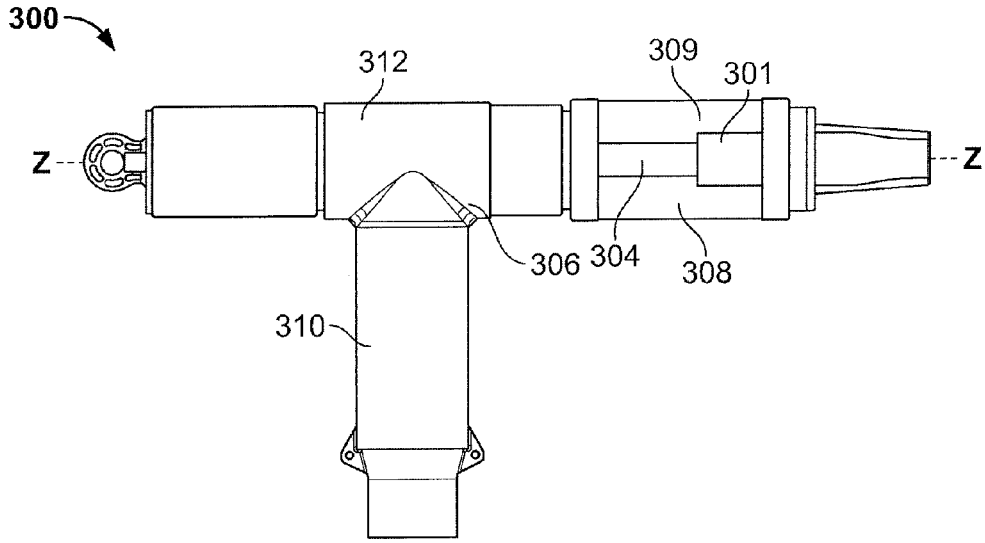
FIG. 10 is a side view of the visible break assembly of FIG. 9 in a closed position.
Figure 11:
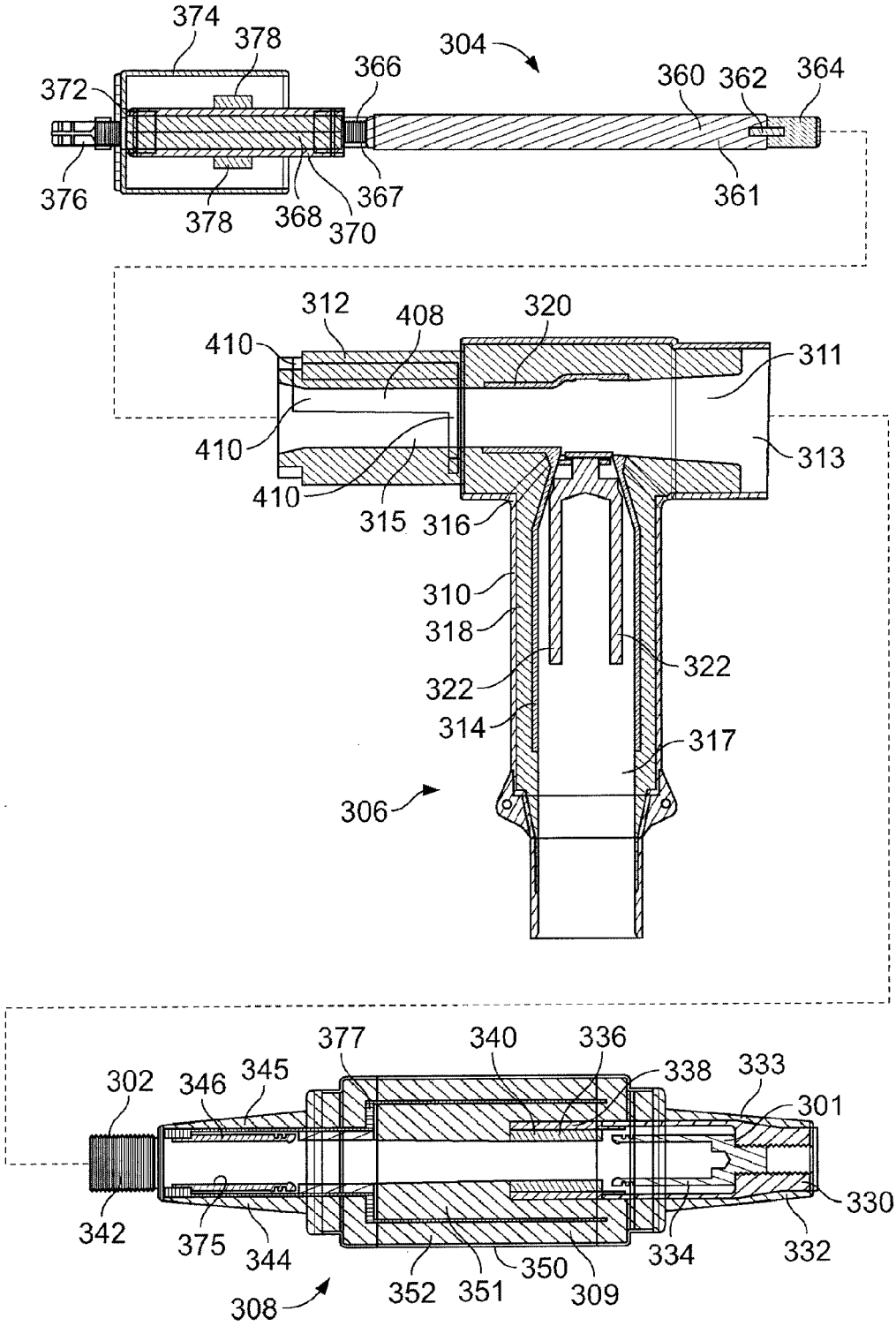
FIG. 11 is an exploded cross-sectional view of the visible break assembly of FIG. 9.
Figure 12A:
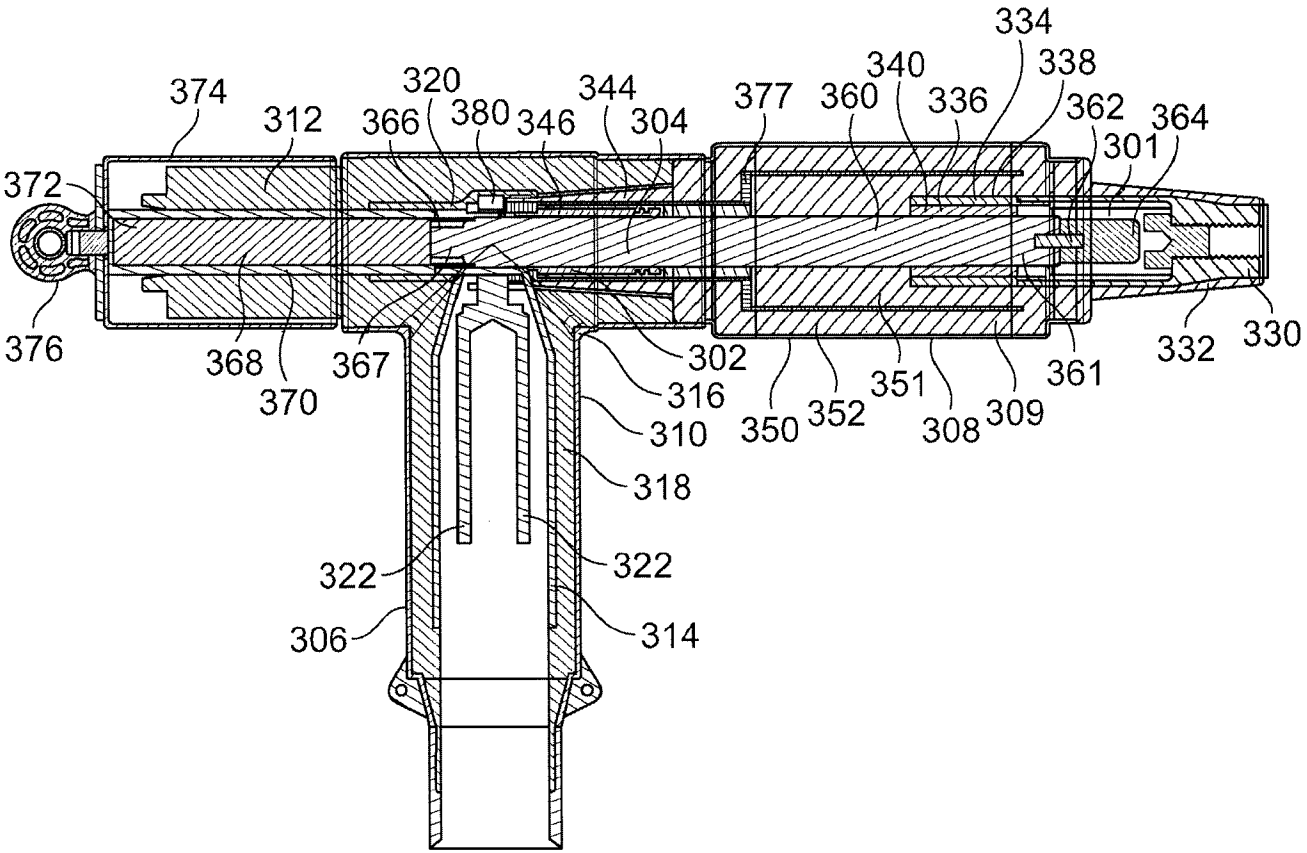
FIG. 12A is a cross-sectional view of the assembled visible break assembly of FIG. 9.

Referring to FIGS. 9–12A, in another implementation, a visible break assembly 300 includes a housing that includes a bushing 308 and a T-shaped casing 306 that resembles a 600A rubber T-connector. Bushing 308 houses a first stationary conductive member 301 for attachment to a first piece of electrical equipment, such as a high voltage power cable (not shown), and a second stationary electrically conductive member 302. Bushing 308 is connected to casing 306 for electrically coupling the second stationary conductive member 302 to a power cable (not shown), as explained below. A conductive rod 304 that is received within casing 306 and bushing 308 can be moved laterally along an axis Z—Z between an open position with an electrical gap between conductive rod 304 and first stationary conductive member 301 (FIG. 9) and a closed position in which conductive rod 304 abuts conductive member 301 to complete an electrical connection between first and second stationary conductive members 301 and 302 (FIGS. 10 and 12A). Bushing 308 includes a transparent or translucent window 309 that allows the connection or gap between connection rod 304 and first stationary conduction member 301 to be visible from outside of bushing 308.

Bushing 308 has a first end portion 344 that extends outside of casing 306, a second end portion 344 that is received in casing 306, and the window 309 that joins end portions 332 and 344. First end portion 332, second end portion 344, and window 309 together define an internal longitudinal bore 375 that extends through bushing 308 to receive rod 304. Window 309 includes an outer ground shield layer 350, an inner voltage shield layer 351, and an insulating layer 352 sandwiched between ground shield layer 350 and voltage shield layer 351. Ground shield layer 350 and voltage shield layer 351 are composed of light-passing materials, as described above with respect to voltage shield layer 111 and ground shield layer 113. Insulating layer 352 is composed of a transparent or translucent insulating material, as described above with respect to insulating layer 115.

First end portion 332 includes an outer insulating wall 333 that receives the first stationary conductive member 301. First stationary conductive member 301 includes a first fixed contact 330 that extends from outer wall 333 to be coupled to a piece of electrical equipment. A first set of finger contacts 334 are threaded to first fixed contact 330 and extend into bushing 308. When rod 304 is inserted into bushing 308, rod 304 is received between finger contacts 334 to form an electrical connection between rod 304, finger contacts 334, and fixed contact 330. Since rod 304 also is connected to contact 346, rod 304 forms an electrical connection with the piece of electrical equipment that is coupled to fixed contact 330 and a second piece of equipment connected to second end portion 344 through stationary conductive member 302.

Second end portion 344 includes an outer insulating wall 345 that receives the second stationary conductive member 302. Second stationary conductive member 302 includes a second fixed contact 342 that extends out of wall 345 and a second set of finger contacts 346 within wall 345. When rod 304 is inserted into bushing 308, rod passes through finger contacts 346, forming an electrical connection between rod 304, finger contacts 346, and fixed contact 342. Second end portion 344 also includes a lock-nut 380 for securing bushing 344 to casing 306.

Casing 306 includes a substantially cylindrical stem portion 310 that intersects with a substantially cylindrical cross portion 312. Each of stem portion 310 and cross portion 312 include an opaque, inner voltage shield layer 314, an opaque, outer ground shield layer 316 and an opaque insulation layer 318 sandwiched between voltage shield layer 314 and ground shield layer 316. In another implementation, layers 314 and 316 may be made of light-passing materials, and layer 318 may be made of transparent or translucent materials, as described above. Cross portion 312 defines a longitudinal bore 311 that has a first end 313 for receiving a second end portion 334 of bushing 308 and a second end 315 for receiving rod 304. Disposed within longitudinal bore 311 is a conductive sleeve 320 that abuts against second stationary conductor 302 of bushing 308. Stem portion 310 defines a longitudinal bore 317 that intersects longitudinal bore 311 of cross portion 312. Disposed within longitudinal bore 317 of stem portion 310 are depending conductive connectors 322 that are electrically coupled to conductive sleeve 320. Depending connective conductors 322 are configured to be attached to a power cable. Thus, second stationary conductor 302 is electrically coupled to the power cable via depending connection conductors 332 and conductive sleeve 320.

Conductive rod 304 includes an electrically conductive shaft 360. Shaft 360 has an end portion 366 that is threaded into an end fitting 367 of an insulating shaft 368, which is surrounded by an insulating sleeve 370. Insulating shaft 368 and insulating sleeve 370 are composed of insulating materials, and may include, for example, a fiberglass shaft wrapped in a plastic sleeve. Insulating shaft 368 has another end fitting 372 that is attached to a cup-shaped cap 374. A handle 376 is threaded into end fitting 372 to secure cap 374 to insulating shaft 368. Cup shaped cap 374 is configured to fit snugly over stem portion 312 of casing 306 when rod 304 is inserted into bore 311 of casing 306.

Pressed into first fixed contact 330 of bushing 308 is an arc snuffing assembly 336. Assembly 336 includes a support tube 338 and an arc snuffer 340. Rod 304 includes an arc follower 364 that is coupled to conductive shaft 360 by a pin 362. When rod 304 is removed from bushing 308, breaking the electrical connection with first conductive member 301, arc snuffing assembly 336 and arc follower 364 interact to cause the interruption of an arc that may form between first conductive member 301 and rod 304. Arc snuffing assembly 336 also may include one or more seals used to confine the arc during the interrupting process.

Figure 12B:
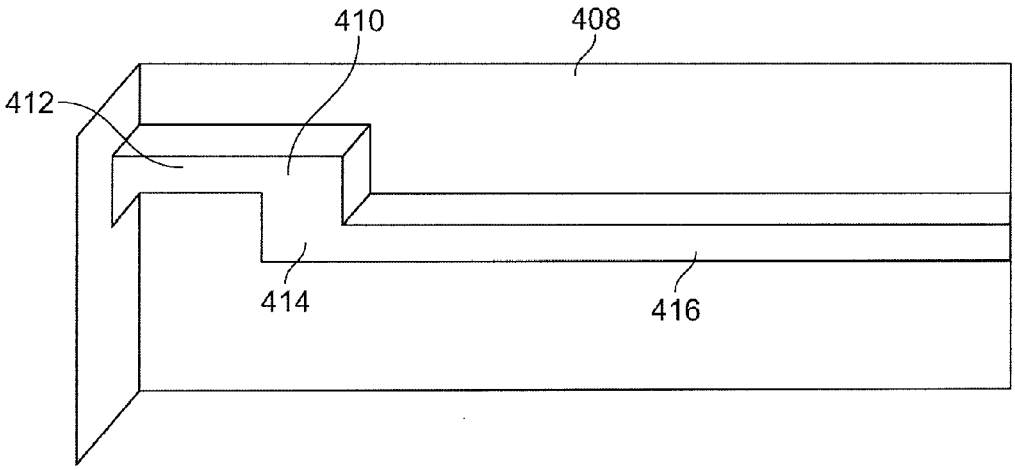
FIG. 12B is an enlarged perspective view of a groove in the visible break assembly of FIG. 9.

Referring also to FIG. 12B, cross portion 312 of casing 306 has an internal wall 408 that defines one or more Z-shaped grooves 410. Insulating shaft 368 of rod 304 includes one or more teeth 378 that are configured to interlock with grooves 410. For convenience, only one groove 410 and one tooth 378 will be described. Groove 410 includes a first longitudinal portion 412 that is substantially parallel to axis Z—Z, an annular portion 414 that is substantially transverse to axis Z—Z, and a second longitudinal portion 416 that is substantially parallel to axis Z—Z. To insert rod 304 into casing 306, tooth 378 of rod 304 is aligned with first longitudinal portion 412 of groove 410 and rod 304 is inserted longitudinally into bore 311. When tooth 378 reaches annular portion 414 of groove 410, rod 304 is rotated by an angle, e.g. about 60 degrees, to align tooth 378 with second longitudinal portion 416 of groove 410 and rod 304 is further advanced longitudinally through bore 311. Similarly, when removing rod 304 from casing 306, rod 304 is retracted longitudinally until tooth 378 reaches annular portion 414 of groove 410. Then rod is rotated by an angle to align tooth 378 with first longitudinal portion 412 of groove 410 and is retracted longitudinally from casing 304. Groove 410 serves as a safety feature to impede rod 304 from being inadvertently inserted into or removed from casing 306.

Figure 12C:
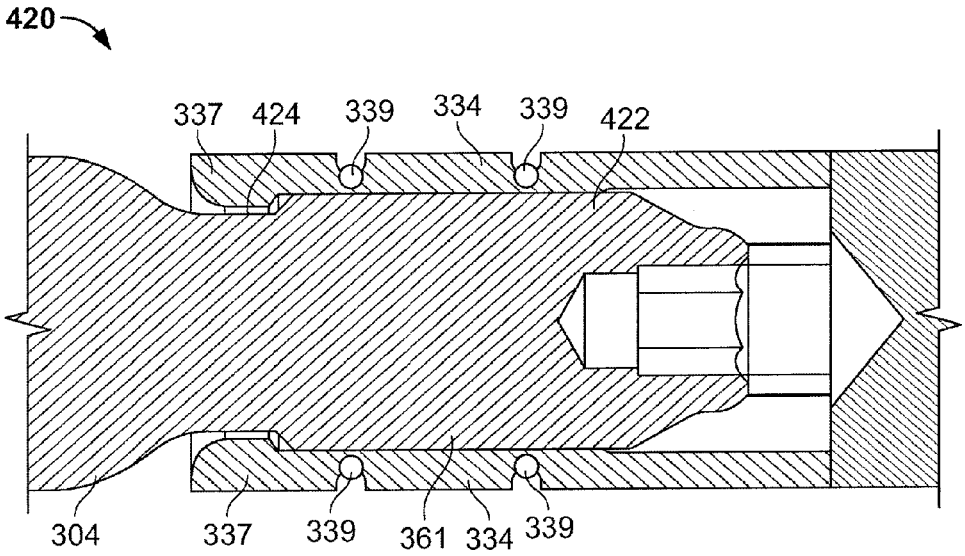
FIG. 12C is an enlarged cross-sectional view of a locking member of the visible break assembly of FIG. 9.

Referring also to FIG. 12C, end 361 of rod 304 and finger contacts 334 together form a locking member 420 for releasably locking rod 304 with finger contacts 334 to maintain a good electrical connection between rod 304 and finger contacts 334. Locking mechanism 420 includes a protrusion 422 on rod 304 that is received between finger contacts 334. Locking mechanism 420 also includes an annular groove 424 on rod 304 that receives pawls 337 on the ends of finger contacts 334. Finger contacts 334 are surrounded by a coil spring 339 that biases finger contacts 334 towards one another to grasp rod 304. In this way, rod 304 is releasably locked between finger contacts 334.

Visible break assembly 300 is assembled and used as follows. Second end portion 344 of bushing 308 is installed into end 313 of longitudinal bore 311 in casing 306 so that second fixed contact 302 forms an electrical connection with conductive sleeve 320. Bushing 308 is locked to casing 306 by tightening lock-nut 380. A first electrical cable (not shown) is inserted into bore 317 of stem portion 311 of casing 306 and crimped so that the cable forms an electrical connection with depending conductive connectors 322 that are electrically coupled to conductive sleeve 320. Fixed contact 330 of bushing 308 is electrically connected to a second electrical cable (not shown), such as by being inserted into a 600A Rubber T Connector, as described above.

To make an electrical connection between first fixed contact 301 and second fixed contact 302, rod 304 is advanced through bore 311 until rod 304 is locked between finger contacts 334 of fixed contact 301. In this way, rod 304 forms an electrical connection between first and second contacts 301 and 302. To break the electrical connection between first and second fixed contacts 301 and 302, handle 376 of rod 304 is pulled out of casing 306. The connection between rod 304 and fixed contact 301 can be seen from outside of casing 306 through window 309.

Figure 13:
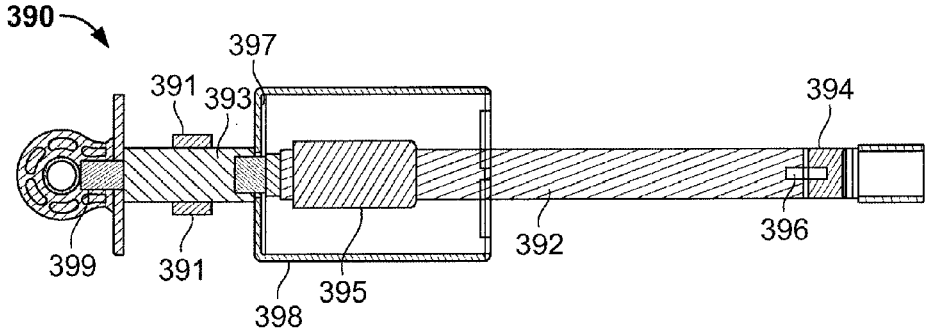
FIG. 13 is a cross-sectional view of a grounding rod for use with the visible break assembly of FIG. 9.

Referring also to FIG. 13, in another implementation, a grounding rod 390 can be used with assembly 300 to ground assembly 300 once conducting rod 304 has been removed. Grounding rod 390 includes a first conductive shaft 392 connected to an insulating tip 394 by a pin 396. Tip 394 is made of a flexible insulating material, such as rubber. Molded around or adhesively attached to a portion of first conductive shaft 392 is an insulating sleeve 395. Also coupled to first conductive shaft 392 is a washer 397 and a cup-shaped cap 398 that has a structure analogous to cap 374 of conductive rod 304 to couple grounding rod 390 to casing 306. Threaded to first conductive shaft 392 is a second conductive shaft 393, which is attached at its other end to a handle 399. Grounding rod 390 includes one or more teeth 391 that interact with grooves 319 in the same way as teeth 378 on conductive rod 304.

Grounding rod 390 is used to ground the cable that is received in stem portion 310 of T-shaped casing 306 after a visible break has been created by removing conductive rod 304 from casing 306. Once the break is established, handle 399 is actuated to place grounding rod 390 into bore 375 of bushing 308 by inserting conductive shaft 392 through bore 311 in casing 306. Conductive shaft 392 is long enough to mate with second fixed contact 302 but not span the gap between first and second contacts 301 and 302. Insulating tip 394 meets and is compressed by bore 375 in bushing 308 and with an insulator 377 that is molded in bore 375 of bushing 308 to form a dielectric seal. Thus, a connection can be made through grounding rod 390 between the second fixed contact 302 and ground.

Other implementations of assembly 300 can include one or more of the following features. If isolation, and not grounding, is needed, the assembly can be used with a rod that is composed of insulating materials only. Partially withdrawing the conducting rod creates a visible break between first and second fixed contacts, while exposing the handle outside of the casing so that a grounding wire can be attached. The cup shaped cap on the grounding rod can include internal teeth and the housing can include external grooves to function in the same way as the teeth on the rod and the groove on the internal portion of the housing.

Figure 14:
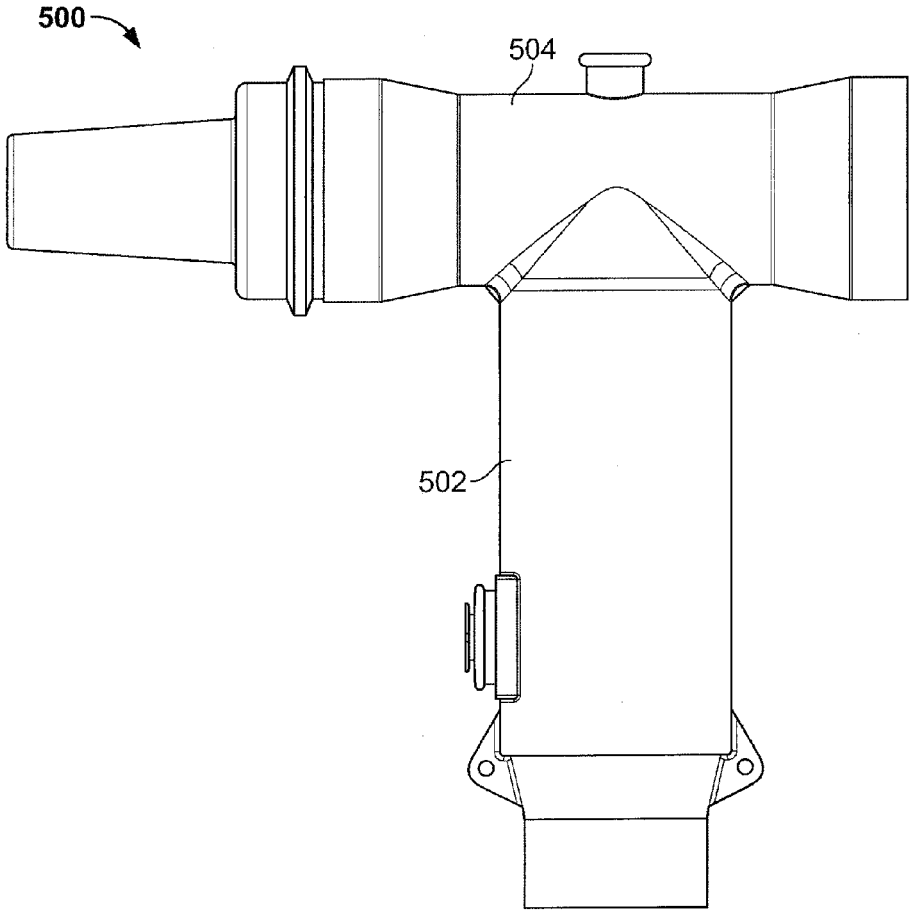
FIG. 14 is a side view of a T-connector with a modified connector plug for use with the conductive rod and bushing of the visible break assembly of FIG. 9.
Figure 15:
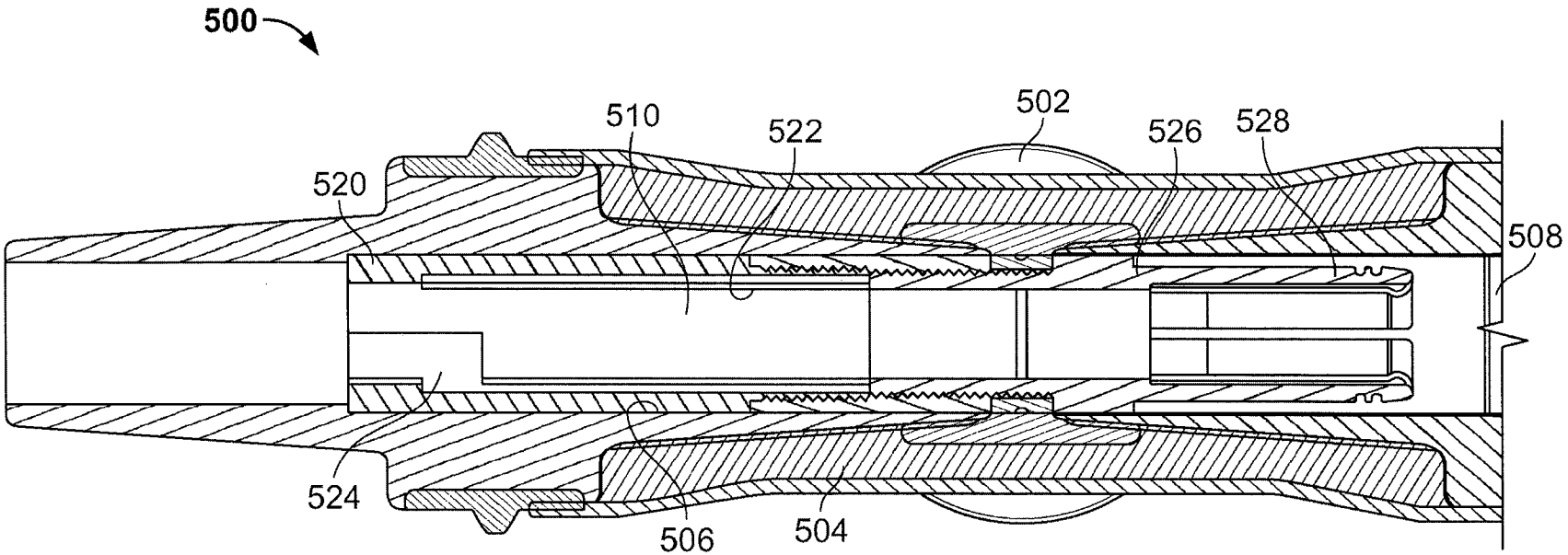
FIG. 15 is cross-sectional view of the T-connector of FIG. 14.
Figure 16:
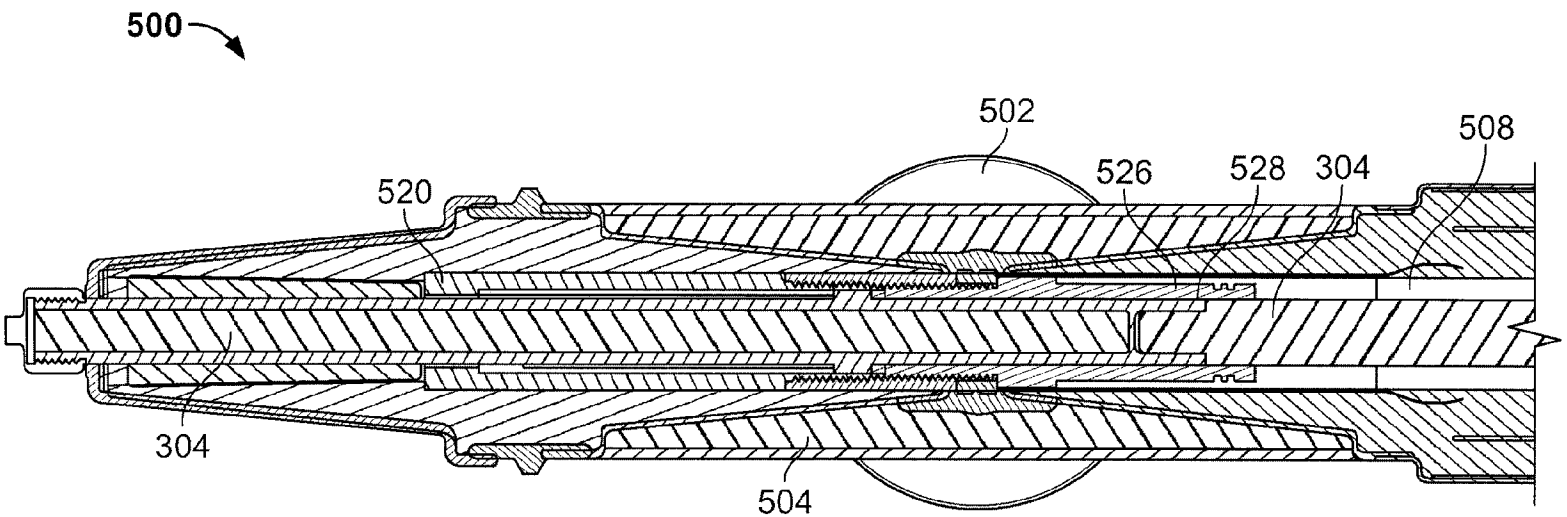
FIG. 16 is a cross-sectional view of the T-connector of FIG. 14 with the conductive rod inserted.

Referring also to FIGS. 14–16, in another implementation, rod 304 and bushing 308 can be used with a standard 600A rubber T-connector 500 that has been modified to include an internal connector plug 520. The standard T-connector 500 includes a substantially cylindrical stem portion 502 that intersects with a substantially cylindrical cross portion 504. Each portion includes an voltage shield layer, a ground shield layer, and an insulation layer sandwiched between the voltage shield layer and the ground shield layer. Cross portion 504 defines a longitudinal bore 506 having a first end 508 for receiving bushing 308. Stem portion 502 defines a longitudinal bore (not shown) that intersects longitudinal bore 510 of cross portion 504 for receiving a power cable (not shown).

The standard T-connector 500 is modified to include the internal connector plug 520 that fits inside bore 510. Connector plug 520 defines a bore 522 for receiving rod 304 and one or more internal grooves 524 that are analogous to grooves 410 described above for receiving teeth 378 on rod 304. Plug 520 includes a conductive portion 526 that serves the same function as conductive sleeve 320 in T-shaped casing 306. Conductive portion 526 includes finger contacts 528 that are configured to receive conductive shaft 360 of rod 304 so that rod 304 can form an electrical connection with finger contacts 528. The T-connector 500, modified with internal connector plug 520, also can be used with grounding rod 390, as described above.

A number of implementations have been described. Nevertheless, it will be understood that various modifications may be made. Accordingly, other implementations are within the scope of the following claims.

What is claimed is:

1. A device comprising:

a first conductive member configured to be electrically coupled to a first component;

a second conductive member configured to be electrically coupled to a second component, the second conductive member being separated from the first conductive member by a gap;

a conductive connecting member that is moveable to make an electrical connection between the first and second conductive members across the gap; and a housing that receives the first conductive member, the second conductive member, and the connecting member, the housing including an insulating layer and a conductive layer, wherein the movement of the connecting member to make the electrical connection is visible through at least a portion of the insulating layer and the conductive layer.

2. The device of claim 1 wherein the conductive layer comprises a transparent or translucent conductive material.

3. The device of claim 2 wherein the conductive material comprises a metallic mesh screen.

4. The device of claim 2 wherein the conductive material comprises a metallic spray-on coating.

5. The device of claim 2 wherein the conductive material is tinted.

6. The device of claim 1 wherein the conductive layer is formed from a transparent circuit board with metallic portions etched onto the circuit board.

7. The device of claim 1 wherein the insulating layer comprises a transparent or translucent insulating material.

8. The device of claim 7 wherein the insulating material comprises acrylic.

9. The device of claim 7 wherein the insulating material comprises epoxy.

10. The device of claim 7 wherein the insulating material comprises urethane.

11. The device of claim 7 wherein the insulating material is tinted.

12. The device of claim 1 wherein the conductive layer comprises an external ground shield layer.

13. The device of claim 12 wherein the housing further comprises an internal voltage shield layer having at least a portion through which the movement of the connecting member to make the electrical connection is visible.

14. The device of claim 13 wherein the insulating layer is sandwiched between the ground shield layer and the voltage shield layer.

15. The device of claim 1 wherein the conductive layer includes an opaque portion through which the movement of the connecting member to make the electrical connection is not visible.

16. The device of claim 1 wherein the insulating layer includes an opaque portion through which the movement of the connecting member to make the electrical connection is not visible.

17. The device of claim 1 wherein the conductive connecting member comprises a rotatable contact coupled to the first conductive member.

18. The device of claim 17 wherein the second conductive member comprises a stationary contact.

19. The device of claim 18 wherein the housing comprises a base member that receives the second conductive member.

20. The device of claim 19 wherein the portion comprises a window that projects from the base member.

21. The device of claim 19 wherein the portion comprises a window that is shaped like the frustrum of a cone.

22. The device of claim 19 wherein the housing further comprises a tip member that projects from the portion and that is coupled to the first conductive member.

23. The device of claim 22 wherein the tip member is configured to rotate the rotatable contact.

24. The device of claim 1 wherein the conductive connecting member comprises a conductive shaft that is rotatable between an open position wherein the conductive shaft is not in contact with at least one of the first and second conductive members, and a closed position wherein the conductive shaft is in contact with both the first and second conductive members.

25. The device of claim 24 wherein the housing includes a wall and a cover that define an interior, open space that contains the conductive shaft.

26. The device of claim 25 wherein the cover includes the portion.

27. The device of claim 26 wherein the wall comprises an opaque layer through which the movement of the conductive connecting member is not visible.

28. The device of claim 27 wherein the wall includes a first bushing for receiving the first conductive member.

29. The device of claim 28 wherein the wall includes a second bushing for receiving the second conductive member.

30. The device of claim 26 further comprising a non-conductive shaft coupled to the conductive shaft.

31. The device of claim 30 wherein the non-conductive shaft is rotatable about an axis to rotate the conductive shaft between the open position and the closed position.

32. The device of claim 31 wherein the cover includes a bearing and the non-conductive shaft extends through the bearing and outside of the housing.

33. The device of claim 1 wherein the conductive connecting member comprises a conductive rod that defines a longitudinal axis, wherein the rod is moveable along the axis.

34. The device of claim 33 wherein the housing comprises a bushing that defines a bore for receiving the rod.

35. The device of claim 34 wherein the bushing includes the portion.

36. The device of claim 35 wherein the housing further comprises a T-shaped casing coupled to the bushing for electrically coupling the second conductive connecting member to the second component.

37. The device of claim 36 wherein the casing includes a stem portion that defines a bore for receiving the second component.

38. The device of claim 36 wherein the casing includes a cross portion that defines a bore for receiving the bushing and the conductive rod.

39. The device of claim 33 wherein the conductive rod includes an arc follower and the bushing includes an arc snuffing assembly that inhibit the formation of an arc between first conductive connecting member and the conductive rod.

40. The device of claim 33 wherein the conductive rod includes a conductive portion.

41. The device of claim 40 wherein the conductive rod includes an insulating portion coupled to the conductive portion.

42. The device of claim 41 wherein the insulating portion includes a tooth and the housing includes a groove for interlocking with the tooth.

43. The device of claim 42 wherein the groove is Z-shaped.

44. The device of claim 33 wherein the conductive rod and the bushing include a locking mechanism.

45. The device of claim 44 wherein the locking mechanism includes a protrusion and an annular groove on the rod for locking with the finger contacts.

46. The device of claim 33 further comprising a grounding rod configured to ground the housing when the conducting rod has been removed from the housing.

47. The device of claim 33 wherein the housing includes a 600A rubber T-connector for receiving the conductive rod.

48. The device of claim 47 wherein the T-connector includes a stem portion that defines a longitudinal bore for receiving the conductive rod.

49. The device of claim 48 wherein the T-connector further comprises a connector plug received in the longitudinal bore for forming an electrical connection with the conductive rod.

50. A method comprising:

moving a conductive connecting member to form and to break an electrical connection between a first conductive member that is electrically coupled to a first component and a second conductive member that is electrically coupled to a second component, the second conductive member being separated from the first conductive member by a gap; and viewing the movement of the conductive connecting member through a portion of a housing that receives the first conductive member, the second conductive member, and the connecting member, wherein the portion includes an insulating layer and a conductive layer that electrically shields the housing.

51. A method of manufacturing a visible break device that includes a housing that receives first conductive member configured to be electrically coupled to a first component, a second conductive member configured to be electrically coupled to a second component, and a conductive connecting member that is moveable across a gap to form and to break an electrical connection between the first and second conductive members, wherein the housing includes a transparent or translucent window that includes a transparent or translucent insulating layer and a transparent or translucent conductive layer, the method comprising:

filling a mold with a transparent or translucent insulating material to form the insulating layer.

52. The method of claim 51 further comprising placing the first conductive member and the second conductive member into the mold.

* * * * *